United States Patent [19]

Dazzi

[11] Patent Number: 4,604,981

[45] Date of Patent: Aug. 12, 1986

[54] INJECTION TIMING DEVICE

[76] Inventor: Jean-Louis Dazzi, 52 Rue des Collonges, Saint Genis Laval - Rhone, France

[21] Appl. No.: 516,114

[22] Filed: Jul. 20, 1983

[30] Foreign Application Priority Data

Jul. 22, 1982 [FR] France ..... 82 13138

[51] Int. Cl.[4] ..... F02M 39/00

[52] U.S. Cl. ..... 123/451; 123/467

[58] Field of Search ..... 123/451, 467, 500, 501, 123/502, 499

[56] References Cited

U.S. PATENT DOCUMENTS

| | | | |
|---|---|---|---|
| Re. 20,254 | 1/1937 | Robertson | 123/451 |
| 2,827,030 | 3/1958 | Strumbos | 123/451 |
| 3,187,733 | 6/1965 | Heintz | 123/467 |
| 3,416,505 | 12/1968 | Steiger | 123/467 |
| 3,851,635 | 12/1974 | Murtin | 123/499 |

*Primary Examiner*—Carl Stuart Miller

*Attorney, Agent, or Firm*—Remy J. VanOphem

[57] ABSTRACT

A fuel distributing device, having a main body, a first external line interposed the needle of an injector and the main body, a second external line interposed the main body and the delivery outlet of the injector, and a third line and a fourth line connected to a source of pressurized fuel. A sleeve, by its position within the main body in which it slides, defines the period of injection, and, consequently, the amount of fuel injected, as determined by the load on the engine. A slide valve moves in each injection cycle and its position controls the initiation of the fuel injection cycle. The slide valve is driven independently of the sleeve.

8 Claims, 17 Drawing Figures

INJECTION TIMING DEVICE

BACKGROUND OF THE PRESENT INVENTION

The present invention relates to an injection timing device intended to regulate the timing of the injection of fuel into an internal combustion engine, and more particularly into a piston engine.

It is known that such an injection timing device should satisfy two main requirements. The first main requirement is control of the amount of fuel to be injected into each cylinder in each combustion cycle. The amount of fuel injected is preferably varied as a function of the desired load for the motor. The second main requirement is control of the instant in time at which the injection operation occurs in relationship to the sequence of events of each combustion cycle and as a function of the desired advance timing of the combustion cycle.

An injection timing device, called a double slide valve device, in which the high fuel pressure is provided at each of the two opposite faces of the injection needle of the fuel injector is already known. When a drop in the pressure on one face of the needle, often referred to as the rearward face of the needle, occurs due to the movement of one of the two slide valves an injection operation is initiated. In fact, the injection needle is then raised off its seat due to the high pressure which continues to prevail on the other face of the injection needle, often referred to as the forward face of the injection needle.

Moving the other slide valve causes the reestablishment of high pressure on the one face or rearward face, of the needle, which causes the reseating of the injection needle with the aid of its adjusting spring. This event corresponds to the end of the injection operation.

In this known system, each of the slide valves is driven separately by the action of fuel at a moderate pressure delivered by microvalves, themselves controlled by an electronic computer.

This known system, thus, makes it possible to control the start and the end of an injection operation, independently, by a computer. On the other hand, it is found that the variation in the opening time of the injection needle and, thus, in the delivery output, is equal to the sum of the variations in the times of opening and closing. The exact amount of fuel delivered is, thus, difficult to reproduce from one combustion cycle to another, thus, resulting in a certain irregularity in the operation of the motor.

SUMMARY OF THE PRESENT INVENTION

The object of the present invention is to avoid this disadvantage of the prior art by making an injection device in which not only the start and the end of the injection operation, but also the duration of the injection operation, are controlled.

An injection timing device according to the present invention includes two sliding distributing elements which are inserted in the high pressure fuel circuit and which are connected to the two ends of the injection needle of a fuel injector. Preferably, and as illustrated in the exemplary drawings affixed hereto, these two distributing elements consist of a slide valve sliding inside a sleeve which in turn slides inside the main body of a manifold element, the longitudinal displacement of the slide valve and of the sleeve relative to the main body being controlled independently of one another.

According to one example of operation of the present invention, the slide valve executes both a first motion in a first longitudinal direction and a second motion in a second longitudinal direction opposite the first longitudinal direction for each combustion cycle.

According to another example of operation of the present invention, the slide valve goes through only a single stroke in a single longitudinal direction for each combustion cycle so that the slide valve translates in a first longitudinal direction for one combustion cycle and in a second longitudial direction opposite the first longitudinal direction for the next combustion cycle.

According to still another example of operation of the present invention, the slide valve executes at least one stroke for each combustion cycle, while the sleeve is moved only when it is desired to alter the amount of fuel injected during one combustion cycle.

BRIEF DESCRIPTION OF THE DRAWINGS

The attached drawings, given as a nonlimiting example, will make it possible to better understand the characteristics of the present invention. In the drawings.

DETAILED DESCRIPTION OF THE PREFERRED EMBODIMENT

Figure 1:
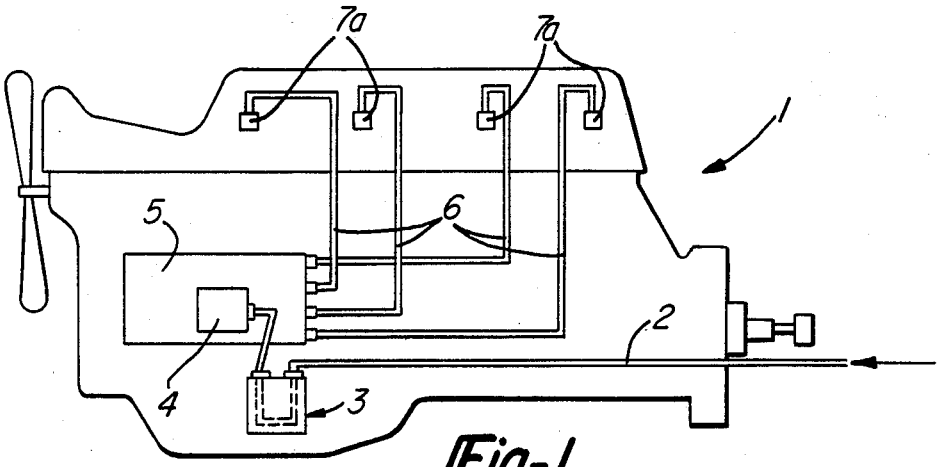
FIG. 1 is a diagrammatic view illustrating the position of an injection timing device according to the present invention in a four cylinder engine.

In FIG. 1 is shown the outline of a diesel engine 1 with four cylinders, not shown. A line 2 delivers fuel from the reservoir, not shown, to a filter 3 of a known type. Finally a high pressure pump 4 sends the fuel to a pump-manifold 5 which has a plurality of high pressure lines 6, each of the high pressure lines being connected with one of the injection systems 7*a* provided for one of the cylinders.

Each injection system 7*a* includes, in a known manner, an injector, not shown, the injection needle of which is subjected to high pressure at each of its ends. According to the present invention, each injection system 7*a* includes a timing injection device 7 of the type which will be described with reference to FIGS. 2 to 17.

Figure 2:
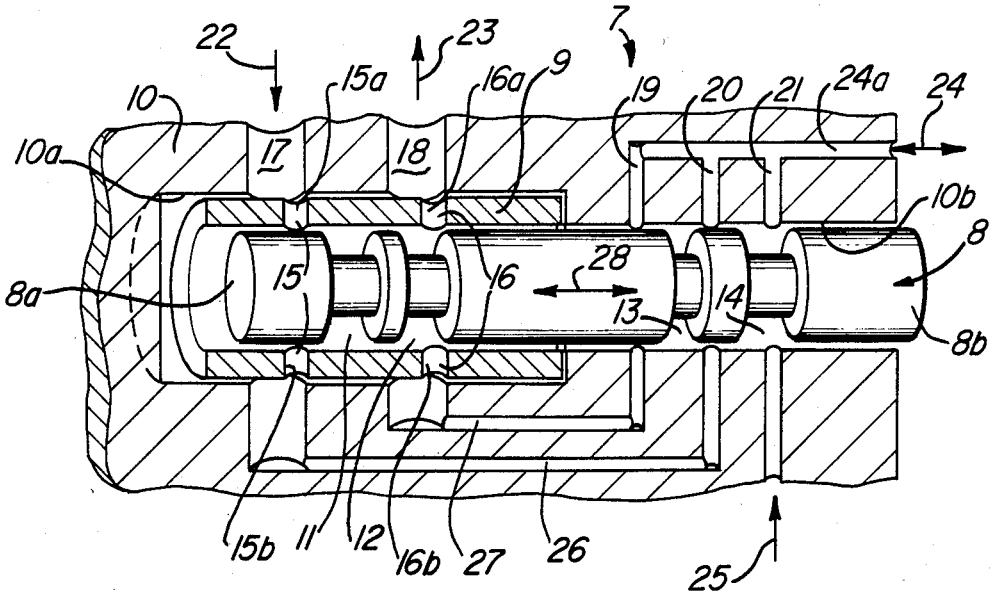
FIG. 2 is a partial longitudinal cutaway view of the injection timing device of FIG. 1 without the structure of the manifold.

As best shown in FIG. 2, the injection device includes a main body 10 and a distributing slide valve 8 having one end 8*a* capable of sliding in a longitudinal direction inside a cylindrical sleeve 9 which in turn slides in a first cylindrical cavity 10*a* in the main body 10. The other end 8*b* of the distributing slide valve 8, opposite the one end 8*a* thereof, is capable of sliding in a second cylindrical cavity 10*b* in the main body 10, the second cylindrical cavity 10*b* being axially aligned with the first cylindrical cavity 10*a* and having a smaller diameter than the first cylindrical cavity. On the distributing slide valve 8 are provided four distributing grooves 11, 12, 13 and 14. The distributing grooves 11 and 12 are located adjacent the one end 8*a* of the distributing slide valve while the distributing grooves 13 and 14 are located adjacent the other end thereof. The cylindrical sleeve 9 is perforated by two diametric bores 15 and 16 which each cross the longitudinal axis of the cylindrical sleeve such as to provide the sleeve with diametrically opposed openings 15*a* and 15*b*, and 16*a* and 16*b*, respectively.

Moreover, transverse bores 17 and 18 are provided in the main body 10. Each of the transverse bores 17 and 18 traverse the first cylindrical cavity 10*a*. External lines 22 and 23 are interconnected with one of the ends of the transverse bore 17 and 18, respectively. Transverse passages 19, 20, and 21 are also provided in the main body 10, each of the transverse passages 19 and 20 traversing the second cylindrical cavity 10*b*. An internal passage 26 in the main body 10 interconnects one end of the transverse passage 20 with the end of the transverse bore 17 opposite the end thereof interconnected with the line 22. Similarly, an internal passage 27 in the main body interconnects one end of the transverse passage 19 with the end of the transverse bore 18 opposite the end thereof interconnected with the line 23.

An internal passage 24*a* in the main body 10 interconnects the ends of the transverse passages 19 and 20, opposite the ends thereof which are interconnected, respectively, with the internal passages 27 and 26. The internal passage 24*a* further is interconnected with one end of the transverse passage 21 and with an external line 24. The other end of the transverse passage 21 is interconnected with an external line 25.

The external lines 22, 23, 24 and 25 are depicted only schematically in the drawing, each being well known in the art.

The line 24 is connected to the rearward face of the injection needle, not represented.

The external lines 25 and 22 are connected to the high pressure pump 5. The external line 23 is connected to the fuel reservoir, that is, the external line 23 constitutes the delivery outlet line.

Known electronic means, not represented, make it possible to selectively drive the slide valve 8 in the directions indicated by the double arrow 28 to any desired longitudinal position. Similarly, the cylindrical sleeve 9 may be selectively driven in one direction or another in the directions indicated by the double arrow 28.

According to one of the important characteristics of the present invention, the slide valve 8 and the cylindrical sleeve 9 are driven independently of one another. More particularly, the slide valve 8 goes through a single stroke, or a forward and rearward movement, as illustrated, for each combustion cycle, while the cylindrical sleeve 9 remains motionless unless it is desired to modify the amount of fuel injected.

Thus, the movements of the slide valve 8 control the timing of the start of injection while the position of the cylindrical sleeve 9 defines the period of injection and, thereby, the amount of fuel that is injected.

The operation of the present invention is as follows:

The distributing groove 11 cooperates with the diametric bore 15 and the transverse bore 17 to selectively open or close the transverse bore 17 to the passage of fuel therealong. The same is true of the groove 12 with respect to the diametric bore 16 and the transverse bore 18, of the groove 13 with respect to the transverse passage 19, and of the groove 14 with respect to the transverse passages 20 and 21.

In FIGS. 5, 8, 11, 14 and 17, the cylindrical sleeve 9 remains motionless, and is located at the extreme left end of the first cylindrical cavity 10*a*. This corresponds to the maximum output delivery condition, that is, where the engine is operating under full load.

Figure 5:
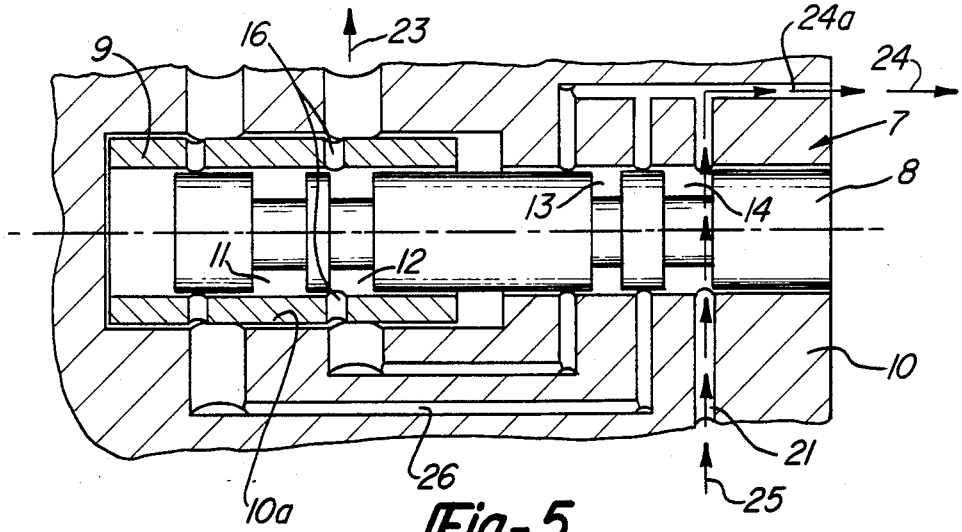
FIGS. 5, 8, 11, 14 and 17 are each views similar to FIGS. 3, 6, 9, 12, and 15 and illustrate the position of the sleeve during a full delivery output condition, the piston being in various positions in these figures.
Figure 6:
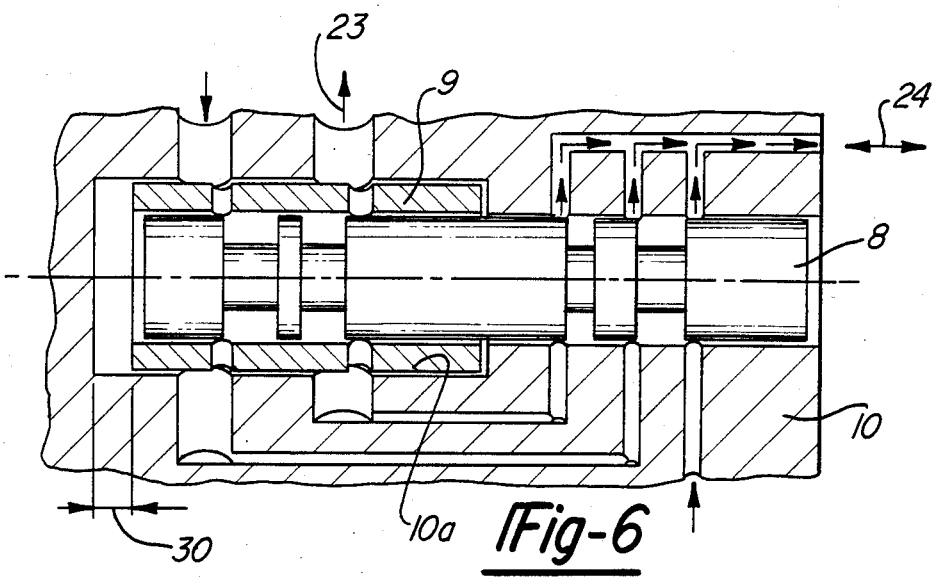
Figure 7:
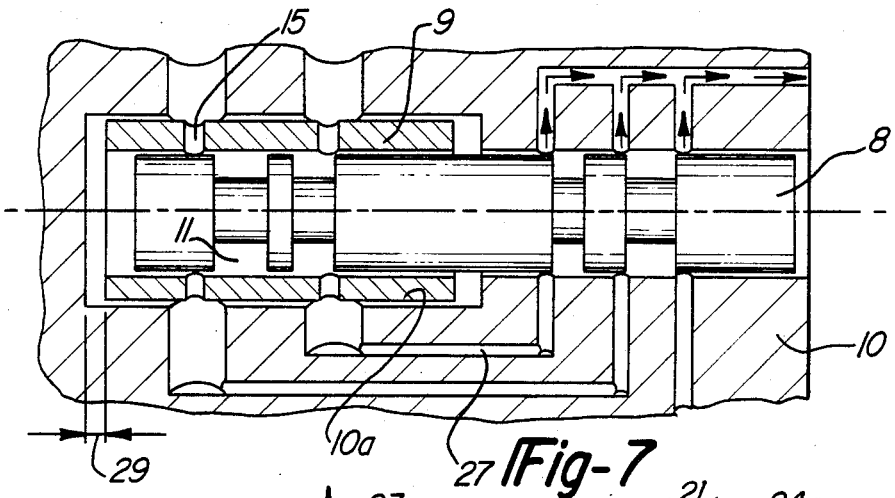

In the position of the slide valve 8 illustrated in FIG. 5, the groove 14 of the slide valve places the external lines 24 and 25 in communication. Thus, the rear face of the injection needle is under pressure, and there is no injection.

Figure 8:
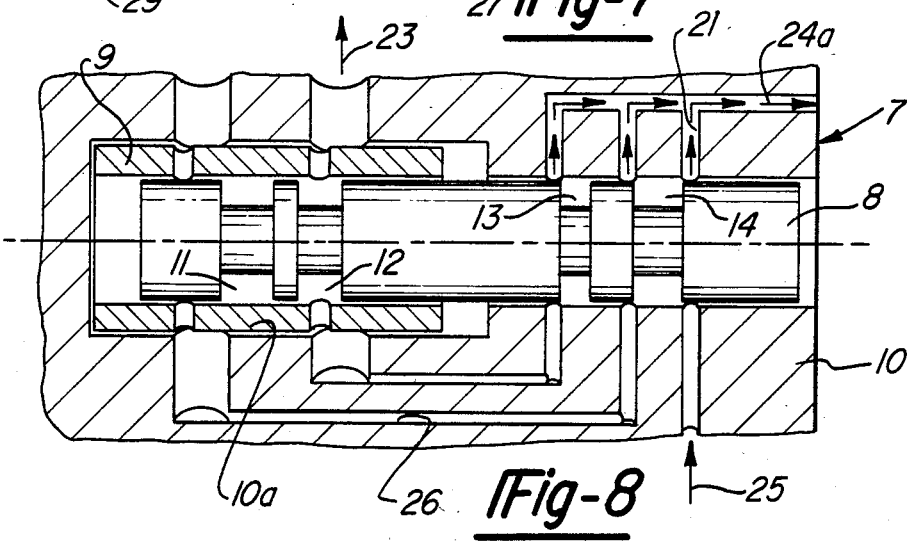
Figure 9:
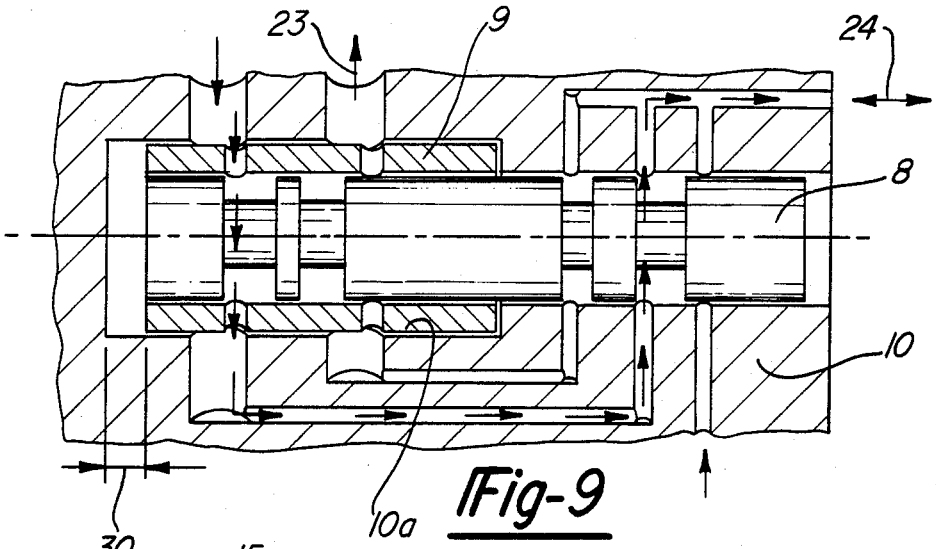
Figure 10:
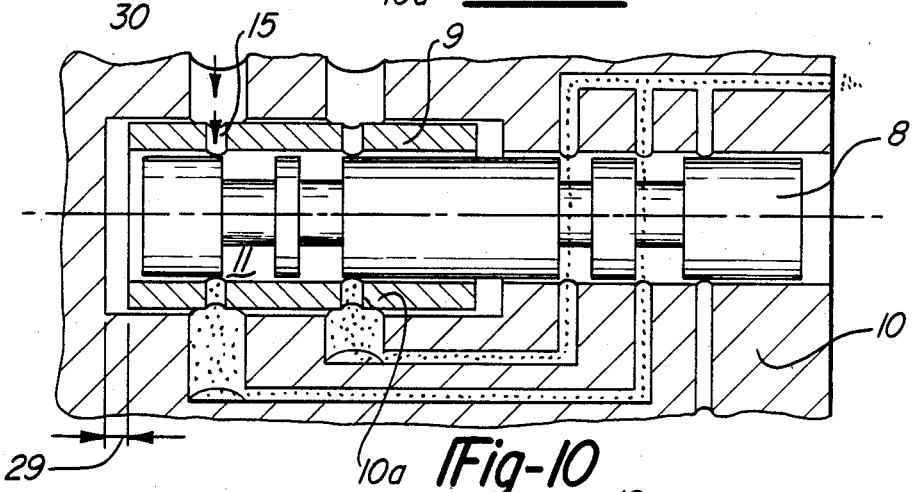
Figure 11:
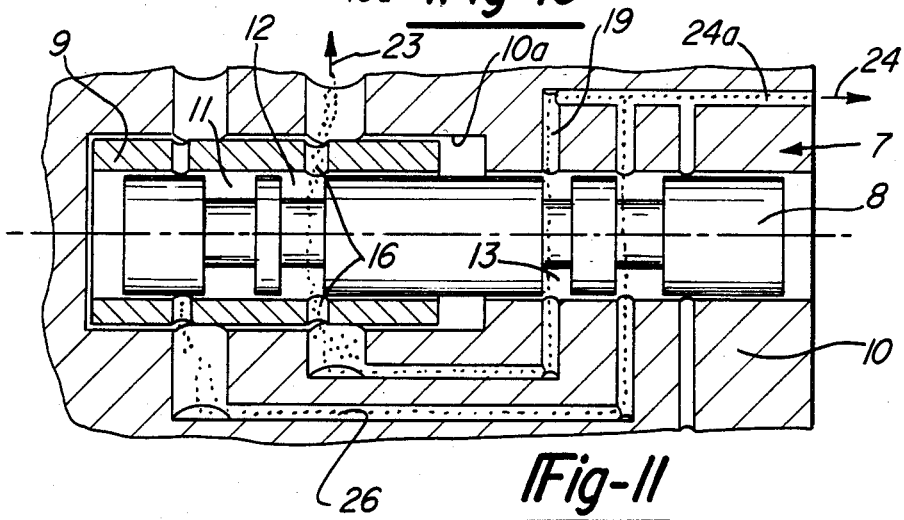
Figure 12:
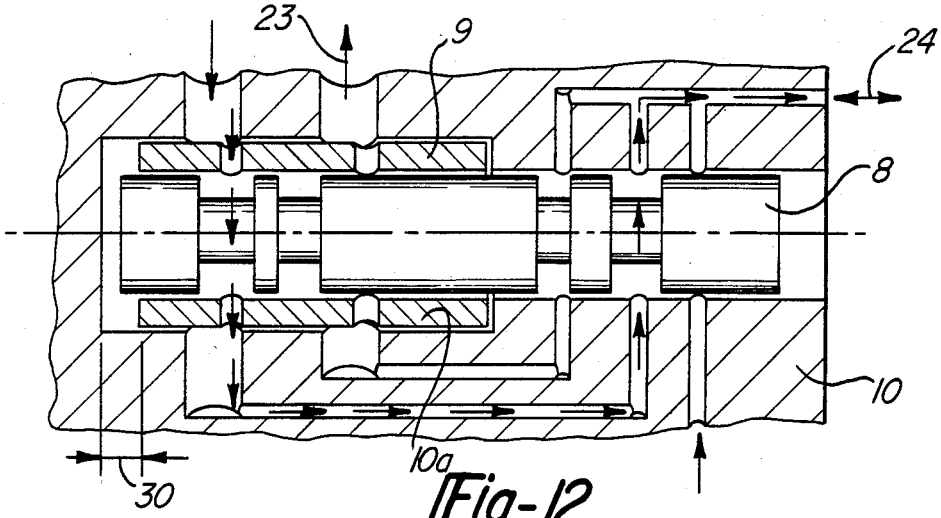

During a first injection cycle, the slide valve 8 starts to move to the left, as shown in FIG. 8, at a substantially constant velocity, regardless of the load and operating rate of the motor. At the start of the movement, as shown in FIG. 8, a portion of the slide valve 8 engages and closes the transverse passage 21, and terminates the communication between the external lines 24 and 25. Subsequently, as shown in FIG. 11, the groove 13 engages and opens the transverse passage 19, thus, connecting the external line 24 of the injector to the delivery line or external line 23, by way of the groove 12 and the diametric bore 16 which then are also mutually engaged. The injection needle may thereafter be raised off its seat, which event corresponds to the start of an injection operation.

During the first part of the movement of the slide valve 8, as illustrated in FIGS. 3 through 8 the internal passage 27 has always been connected to the delivery line or external line 23 through the groove 12 and through the diametric bore 16. The start of an injection operation is, thus, independent of the position of the cylindrical sleeve 9.

Figure 14:
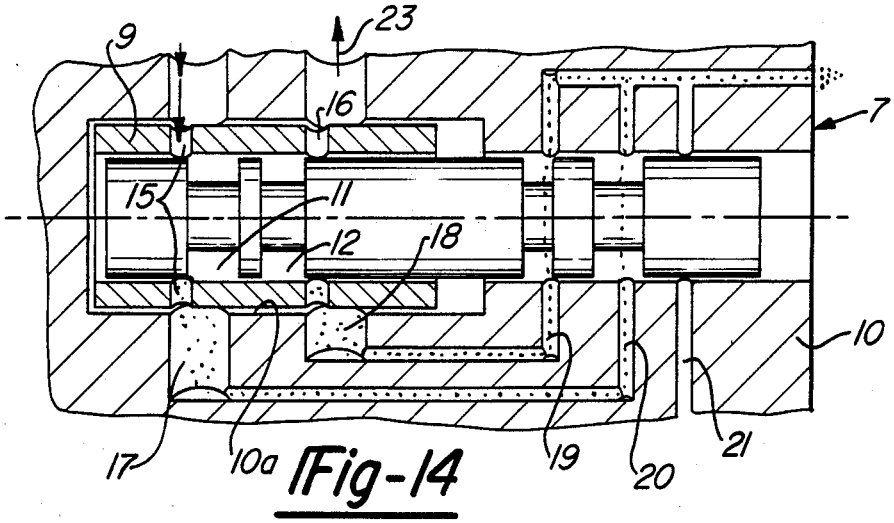
Figure 15:
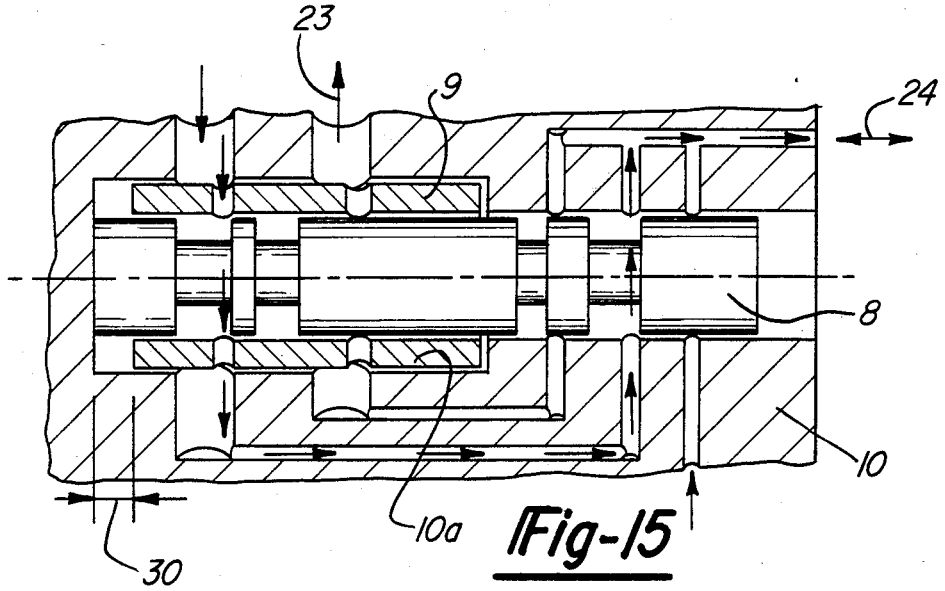
Figure 16:
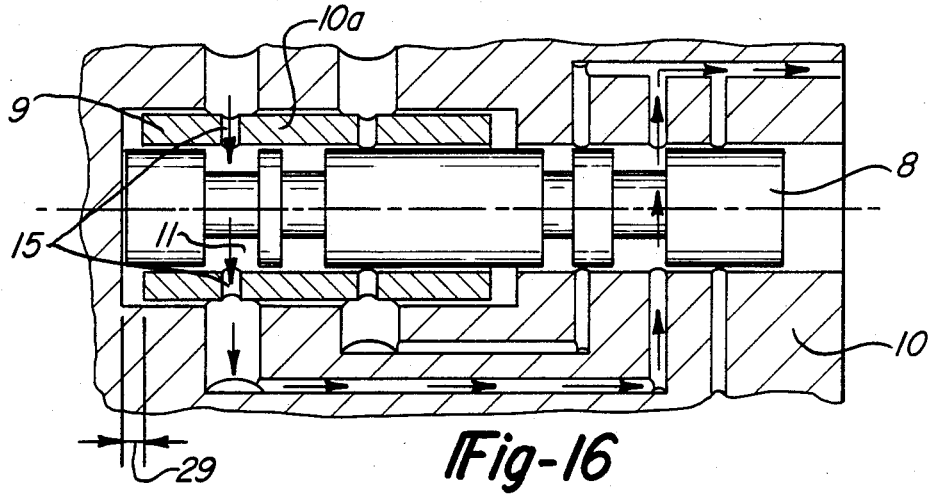
Figure 17:
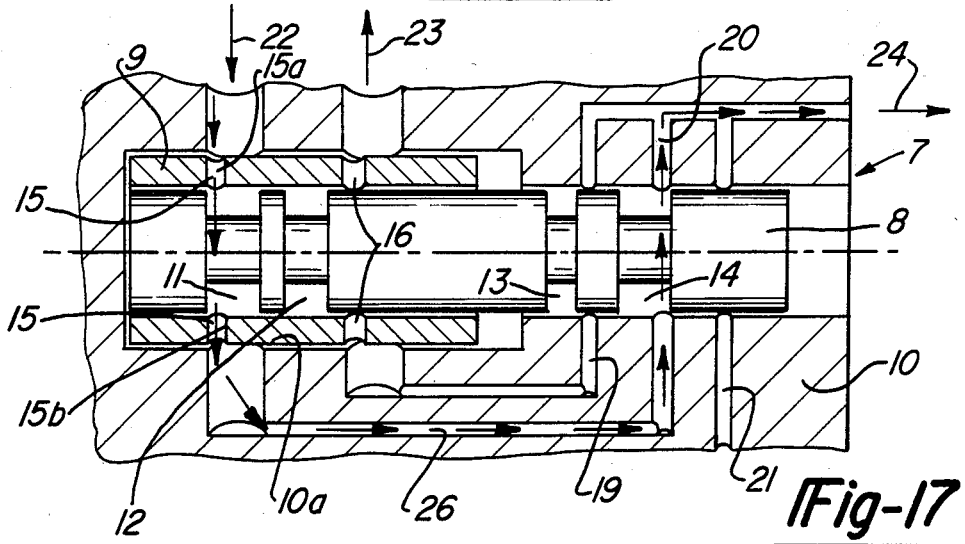

Continuing its movement to the left as depicted in FIG. 14, the distributing groove 12 moves past the diametric bore 16 and the cylindrical wall of the slide valve 8 engages the diametric bore 16, so that the injection device is thenceforth isolated from the delivery of fuel thereto. Finally, as shown in FIG. 17, the groove 11 engages and opens the diametric bore 15 and the distributing groove 14 engages and opens the transverse passage 20. Thenceforth, the external line 24 is again connected to the high pressure of the external line 22 through the diametric bore 15, the groove 11, the internal passage 26, the distributing groove 14 and the transverse passage 20. This corresponds to the moment of the end of an injection operation. After the injection operation which has just been described, it is seen that this moment of the end of an injection operation depends solely on the relative position of the cylindrical sleeve 9 and of the slide valve 8, since the velocity of the slide valve 8 is constant. In other words, the amount of fuel injected depends only on the position of the cylindrical sleeve 9. This amount remains constant when the cylindrical sleeve 9 is immobile during several combustion cycles.

Figure 13:
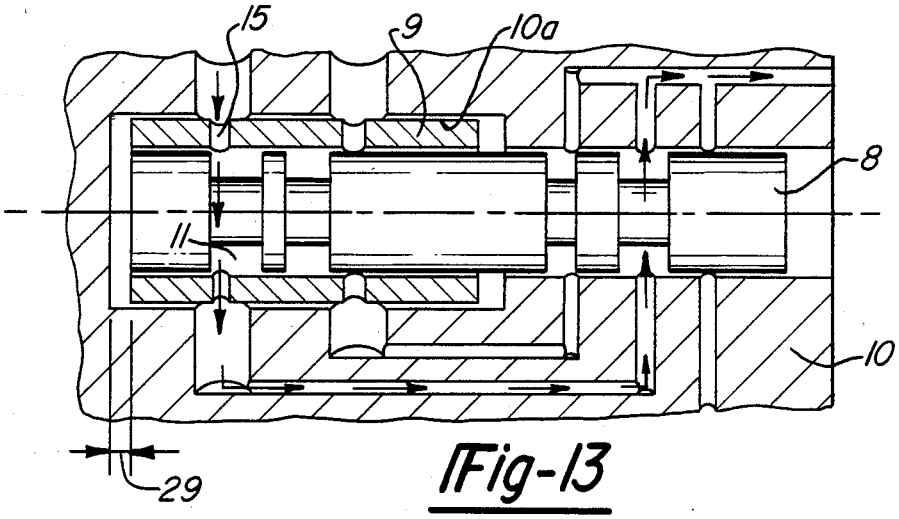

FIGS. 4, 7, 10, 13 and 16 illustrate the sequence of steps of an injection operation while the sleeve 9 occupies an intermediate position in the first cylindrical cavity 10*a*. In this case, due to the distance 29 by which the sleeve 9 is shifted to the right, as compared to the previously described injection operation, the diametric bore 15 is more rapidly uncovered by the distributing groove 11. The injection operation ends, as shown in FIG. 13, before the slide valve 8 has gone all the way in its stroke to the left side, as illustrated in the drawings. The injection operation, thus, terminates sooner, and the amount of fuel injected is reduced.

FIGS. 3, 6, 9, 12 and 15 illustrate the operation of the device when the cylindrical sleeve 9 is shifted longitudinally to the most extreme position toward the right that it may assume within the first cylindrical cavity 10*a*. This maximum shift, depicted by reference numeral 30, is substantially equal to the amplitude of the stroke of the slide valve 8. In this case, the external line 24 of the injector is never connected to the delivery line or external line 23. The injector, thus, remains constantly at high pressure at the two ends of the injection needle, which is now subjected only to the thrust of its own calibration spring and, therefore, remains closed. This corresponds to zero amount of fuel injected.

The slide valve 8 and the cylindrical sleeve 9 are each actuated by means of either a hydraulic drive or an electromechanical drive, and in either case with or without a restoring spring, as desired. The commands for regulating the time of opening of the injection needle and for regulating the injection period each depend on a computer, the input parameters of which represent the various operating conditions of the vehicle and/or the commands received from the driver, and the outputs of which are defined on the basis of these inputs by means of a suitable program governing the operation of the computer.

The next succeeding injection operation can be accomplished in a similar manner during the movement of the slide valve from left to right. In this case, as compared to the preceding description, the relative position of the parts corresponding to the start of placing the delivery line in communication with the rear face of the injector during the prior injection operation becomes the relative position thereof at the end of the subsequent injection operation, and vice versa.

Figure 3:
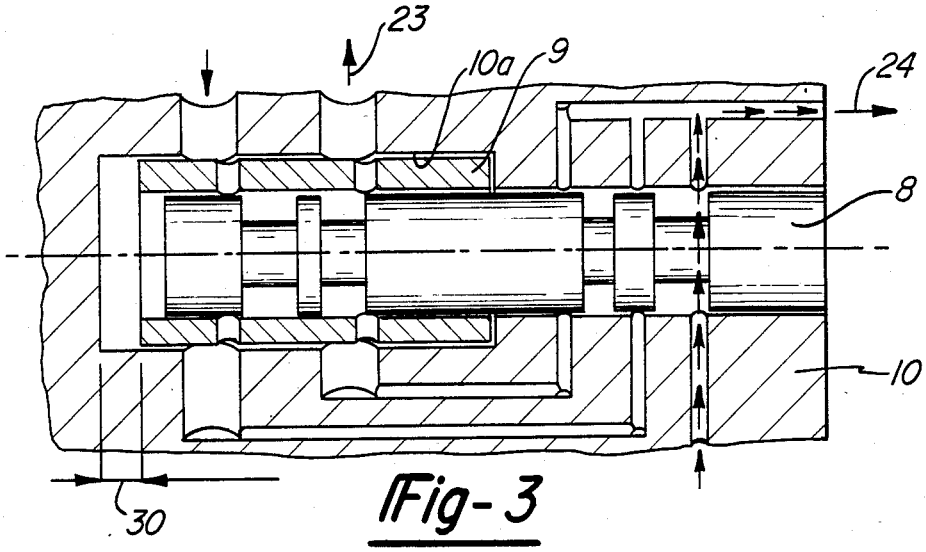
FIGS. 3, 6, 9, 12 and 15 are each partial longitudinal sectional views of the injection timing device of FIG. 1, and each illustrate the position of the sleeve during a phase with zero delivery, the piston being in various positions in these figures.
Figure 4:
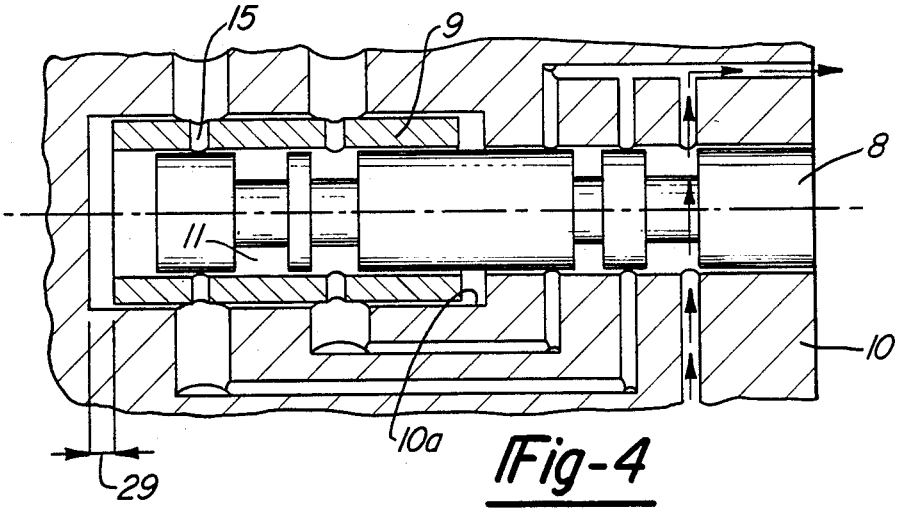
FIGS. 4, 7, 10, 13 and 16 are each views similar to FIGS. 3, 6, 9, 12 and 15, respectively, and illustrate a phase of partial delivery, that is, a condition where the sleeve is in an intermediate position, the piston being in various positions in these figures.

Further, the next succeeding injection may also be accomplished in an identical way to the foregoing one if, between two injections, the slide valve again assumes its initial position, that is, fully to the right, as depicted in FIGS. 3, 4, and 5, prior to the start of the first phase of each and every injection operation. In this case, it is necessary to provide an extra valve between the injection device 7 which has just been described, and the injector, in such a way that, during the return stroke of the slide valve, the rear face of the injection needle remains constantly subjected to high pressure. This extra valve may be a manifold playing the part of a three-way cock connecting the injector to the injection device during the injection operation, and to a high pressure source between two consecutive injection operations, the communication being controlled by the computer or any other appropriate means.

Having, thus, described the present invention by way of a detailed description of an exemplary embodiment, it will be apparent to those skilled in the art that many modifications may be made from the exemplary embodiment without departing from the spirit of the present invention or the scope of the claims appended hereto.

What is claimd as novel is as follows:

1. A fuel injection timing device for insertion in the high pressure fuel circuit of an internal combustion engine, and for controlling the operation of a fuel injection needle, said fuel injection timing device comprising:

a manifold comprising:

a longitudinally extending bore having an enlarged portion;

a pair of transversely extending passages communicating with said longitudinally extending bore;

three additional spaced apart transverse passages communicating with said longitudinally extending bore; and at least one internal passage connecting said three additional spaced apart transverse passages to the rear of said fuel injection needle, the third of said three additional passages being connected to said high pressure fuel circuit for the flow of fuel from said high pressure fuel circuit to said fuel injection needle through said manifold;

a sleeve slidably mounted in said enlarged portion of said longitudinally extending bore of said manifold, said sleeve having a pair of spaced apart holes extending transversely therethrough, one of said pair of spaced apart holes communicating with said high pressure fuel circuit, the other of said pair of spaced apart holes communicating with a line for delivery of fuel to said engine; and means for slidably moving said sleeve in said enlarged portion of said longitudinally extending bore within said manifold such that said sliding movement of said sleeve selectively moves said pair of spaced apart holes in said sleeve into and out of alignment with said pair of transversely extending passages in said manifold to control the termination of the flow of fuel through said manifold; and a sliding valve having one end slidably mounted within said sleeve; an opposite end slidably mounted within said longitudinally extending bore of said manifold; and means for slidably moving said sliding valve in said manifold, said one end comprising a pair of spaced apart grooves whereby said means for slidably moving selectively moves said pair of spaced apart grooves of said sliding valve into and out of alignment with said pair of spaced apart holes in said sleeve; said opposite end of said sleeve comprising a pair of spaced apart grooves such that as said means for slidably moving said sliding valve selectively moves said sliding valve, one of said pair of spaced apart grooves communicates with one of said three additional spaced apart transverse passages while the other of said pair of spaced apart grooves communicates with said second or said third of said three additional spaced apart transverse passages, the position of said pair of spaced apart grooves in said opposite end of said sliding valve with respect to said three additional spaced apart transverse passages in said manifold controlling the operation of said fuel injection needle to initiate the flow of fuel therethrough.

2. The fuel injection timing device according to claim 1 in which said sleeve does not slide within said manifold when there is no change in the rate of fuel flow through said manifold.

3. The fuel injection timing device according to claim 1 further comprising hydraulic drive means for driving said sliding valve within said manifold in a first longitudinal direction and in a second longitudinal direction opposite to said first longitudinal direction, and for driving said sleeve within said manifold in a first longitudinal direction and in a second longitudinal direction opposite to said first longitudinal direction, said hydraulic drive means driving said sleeve independently of said sliding valve.

4. The fuel injection timing device according to claim 1 further comprising electromechanical drive means for driving said sliding valve within said manifold in a first longitudinal direction and in a second longitudinal direction opposite to said first longitudinal direction, and for driving said sleeve within said manifold in a first longitudinal direction and in a second longitudinal direction opposite to said first longitudinal direction, said electromechanical drive means driving said sleeve independently of said sliding valve.

5. The fuel injection timing device according to claim 3 in which said sliding valve slides in said first longitudinal direction and in said second longitudinal direction free from any spring action thereagainst.

6. The fuel injection timing device according to claim 4 in which said sliding valve slides in said first longitudinal direction and in said second longitudinal direction free from any spring action thereagainst.

7. The fuel injection timing device according to claim 5 further comprising a computer for controlling the operation of said hydraulic drive means in response to the operating conditions of said internal combustion engine by means of a suitable program.

8. The fuel injection timing device according to claim 6 further comprising a computer for controlling the operation of said electromechanical drive means in response to the operating conditions of said internal combustion engine by means of a suitable program.

* * * * *

UNITED STATES PATENT AND TRADEMARK OFFICE

CERTIFICATE OF CORRECTION

PATENT NO. : 4,604,981

DATED : August 12, 1986

INVENTOR(S) : Jean-Louis Dazzi

It is certified that error appears in the above-identified patent and that said Letters Patent is hereby corrected as shown below:

Column 2, line 13, delete "longitudial" and insert

---- longitudinal ----.

Signed and Sealed this

Thirteenth Day of January, 1987

*Attest:*

DONALD J. QUIGG

*Attesting Officer*

*Commissioner of Patents and Trademarks*